US011408449B2

(12) United States Patent
Brabec

(10) Patent No.: US 11,408,449 B2
(45) Date of Patent: Aug. 9, 2022

(54) DITHERING HYDRAULIC VALVES TO MITIGATE STATIC FRICTION

(71) Applicant: Topcon Positioning Systems, Inc., Livermore, CA (US)

(72) Inventor: Vernon Joseph Brabec, Livermore, CA (US)

(73) Assignee: Topcon Positioning Systems, Inc., Livermore, CA (US)

( * ) Notice: Subject to any disclaimer, the term of this patent is extended or adjusted under 35 U.S.C. 154(b) by 364 days.

(21) Appl. No.: 16/585,784

(22) Filed: Sep. 27, 2019

(65) Prior Publication Data

US 2021/0095701 A1 Apr. 1, 2021

(51) Int. Cl.

| | |
|---|---|
| ***F15B 15/20*** | (2006.01) |
| ***F15B 20/00*** | (2006.01) |
| ***F15B 21/12*** | (2006.01) |

(52) U.S. Cl.

CPC ..... *F15B 15/204* (2013.01); *F15B 20/00* (2013.01); *F15B 21/12* (2013.01); *F15B 2211/328* (2013.01); *F15B 2211/50563* (2013.01); *F15B 2211/863* (2013.01); *F15B 2211/8646* (2013.01)

(58) Field of Classification Search

CPC .... F15B 13/043; F15B 2211/328; F15B 9/09; E02F 9/2228; E02F 9/2285

See application file for complete search history.

(56) References Cited

U.S. PATENT DOCUMENTS

| | | | | |
|---|---|---|---|---|
| 6,047,228 | A | 4/2000 | Stone et al. | |
| 6,285,913 | B1 * | 9/2001 | Hagglund | F15B 9/09 700/44 |
| 7,318,292 | B2 | 1/2008 | Helbling et al. | |
| 7,878,481 | B2 * | 2/2011 | Kallfass | E02F 9/226 251/129.15 |
| 7,975,410 | B2 | 7/2011 | Faivre et al. | |
| 9,322,149 | B2 | 4/2016 | Takaura et al. | |
| 9,404,237 | B2 | 8/2016 | Faivre et al. | |
| 9,410,305 | B2 | 8/2016 | Matsuyama et al. | |
| 9,469,969 | B2 | 10/2016 | Kanari et al. | |

(Continued)

FOREIGN PATENT DOCUMENTS

| | | | | |
|---|---|---|---|---|
| DE | 112016000015 T5 | 12/2016 | | |
| DE | 102017223143 A1 * | 6/2019 | | H01F 7/1844 |

(Continued)

OTHER PUBLICATIONS

Extended European Search Report dated Jan. 4, 2019, in connection with European Application No. 18190882.3; 8 pgs.

(Continued)

*Primary Examiner* — Thomas E Lazo

(74) *Attorney, Agent, or Firm* — Chiesa Shahinian & Giantomasi PC

(57) ABSTRACT

A method and apparatus for dithering hydraulic valves to mitigate static friction ("stiction") associated with the hydraulic valves. A first hydraulic valve and a second hydraulic valve are dithered to mitigate stiction associated with those valves. The dithering of the first and second hydraulic valves also cause dithering of a main hydraulic valve associated with the first and second hydraulic valves. Accordingly, stiction of three hydraulic valves of a hydraulic system is mitigated.

18 Claims, 7 Drawing Sheets

(56) References Cited

U.S. PATENT DOCUMENTS

| | | | | |
|---|---|---|---|---|
| 9,540,793 | B2 | 1/2017 | Kami et al. | |
| 9,677,251 | B2 | 6/2017 | Kitajima | |
| 9,725,874 | B2 | 8/2017 | Meguriya et al. | |
| 9,803,340 | B2 | 10/2017 | Shimano et al. | |
| 10,443,214 | B2 | 10/2019 | Shimano et al. | |
| 2008/0162004 | A1 | 7/2008 | Price et al. | |
| 2009/0234508 | A1 | 9/2009 | Kallfass et al. | |
| 2013/0333364 | A1 | 12/2013 | Carpenter et al. | |
| 2016/0251835 | A1 | 9/2016 | Kitajima et al. | |
| 2016/0251836 | A1 | 9/2016 | Baba et al. | |
| 2016/0281323 | A1* | 9/2016 | Imaizumi | E02F 9/0841 |
| 2017/0121930 | A1 | 5/2017 | Kitajima et al. | |
| 2017/0284057 | A1 | 10/2017 | Moriki et al. | |
| 2017/0314234 | A1* | 11/2017 | Paull | E02F 3/32 |
| 2018/0112685 | A1* | 4/2018 | Beschorner | G05D 7/0664 |
| 2018/0230671 | A1 | 8/2018 | Wu | |
| 2018/0305898 | A1* | 10/2018 | Kobayashi | E02F 9/2292 |
| 2019/0063041 | A1 | 2/2019 | Izumi et al. | |
| 2019/0078290 | A1 | 3/2019 | Kamada et al. | |
| 2019/0169818 | A1 | 6/2019 | Narikawa et al. | |
| 2019/0226181 | A1 | 7/2019 | Imura et al. | |

FOREIGN PATENT DOCUMENTS

| | | | | |
|---|---|---|---|---|
| DE | 102017223143 | A1 | | 6/2019 |
| JP | H11-190305 | A | | 7/1999 |
| JP | 2000-018209 | A | | 1/2000 |
| JP | 2003-194013 | A | | 7/2003 |
| JP | 2003194013 | A | * | 7/2003 |
| JP | 2006265954 | A | | 10/2006 |
| WO | 2003021365 | A2 | | 3/2003 |
| WO | 2012067975 | A2 | | 5/2012 |

OTHER PUBLICATIONS

International Search Report and Written Opinion mailed in connection with International Patent Application No. PCT/US2020/047683, filed Sep. 27, 2019, 11 pgs.

Non-Final Office Action dated Dec. 30, 2019, in connection with Utility U.S. Appl. No. 16/113,060, filed Aug. 27, 2018, 19 pgs.

Shimano et al., "Development of PC210LCi-10/PC200i-10 Machine Control Hydraulic Excavator," Komatsu Technical Report, 2014, vol. 60, No. 167, pp. 1-7.

International Search Report and Written Opinion dated Nov. 27, 2020, in connection with International Patent Application No. PCT/US2020/047544, filed Sep. 27, 2019, 10 pgs.

Final Office Action dated Jun. 25, 2020, in connection with U.S. Appl. No. 16/113,060, filed Aug. 27, 2018, 11 pgs.

Non-Final Office Action dated Jan. 19, 2022, in connection with U.S. Appl. No. 16/113,060, filed Aug. 27, 2018, 18 pgs.

Final Office Action dated May 25, 2022, in connection with U.S. Appl. No. 16/113,060, filed Aug. 27, 2018.

* cited by examiner

DITHERING HYDRAULIC VALVES TO MITIGATE STATIC FRICTION

BACKGROUND

Construction machines, such as excavators, have implements for modifying a surface. A typical excavator implement includes a hydraulically driven boom, stick, and bucket members each with a respective hydraulic cylinder and can be moved by applying hydraulic fluid pressure to the cylinder. Various valves are used to apply the hydraulic fluid pressure to the cylinders based on input from a user.

One problem associated with these valves is that they can cause a delay between user input and movement of an implement. This delay is caused, at least in part, by static friction, which prevents immediate movement of a valve component in response to hydraulic fluid pressure urging the component to move. Static friction is the friction occurring between two surfaces that resists movement of the surfaces relative to each other. As hydraulic fluid pressure urging the component to move increases, static friction is overcome and only kinetic friction remains, which requires less force than static friction to overcome. For example, in a pilot style system in which pilot valves actuate in response to user input, a pilot valve applies increasing hydraulic fluid pressure urging a hydraulic component to actuate, static friction is overcome and only kinetic friction remains. These static friction delays can make control of movement of the members of an implement by a user more complex and confusing.

SUMMARY

The present disclosure relates generally to hydraulic valves, and more particularly to techniques for mitigating delays between user input and movement of a hydraulic cylinder caused by static friction.

In one embodiment, a method for mitigating static friction ("stiction") includes the steps of dithering a first hydraulic valve (i.e., continuous back and forth motion of the valve) and dithering a second hydraulic valve. Outputs of each of the first hydraulic valve and the second hydraulic valve are connected to inputs of a main hydraulic valve. The main hydraulic valve dithers in response to hydraulic fluid pressure applied to its inputs that occur due to dithering of the first hydraulic valve and the second hydraulic valve. User input is received to actuate a hydraulic cylinder associated with the main valve. A controller transmits a signal to the first hydraulic valve which causes hydraulic fluid pressure to be applied to one of the inputs of the main valve in response to the user input. The hydraulic cylinder associated with the main valve is actuated by the application of hydraulic fluid pressure from one of the outputs of the main valve in response to the hydraulic fluid pressure applied to a corresponding input of the main valve.

An apparatus and an excavator in which hydraulic valves are dithered to mitigate static friction are also disclosed.

DETAILED DESCRIPTION

The methods and apparatus described herein mitigate static friction, referred to herein as "stiction." Stiction is the general inability of a hydraulic valve or cylinder to respond immediately and fully to a command (e.g., electrical signal or hydraulic fluid pressure) transmitted to it when it is not currently in motion. For example, an electro-mechanical hydraulic valve that is not receiving a command remains at rest in a particular position. The valve while at rest experiences static friction which is higher than kinetic friction. Since the static friction is much higher than the kinetic friction, more force is required to begin actuation of the hydraulic valve when it is at rest than when the valve is moving. Stiction causes a delay from a time when an input is received to when a respective hydraulic cylinder actuated by hydraulic valves moves. Such delays can result in difficulty in controlling movement of a component driven by a hydraulic cylinder as used in various machines, such as construction machines.

Figure 1A:
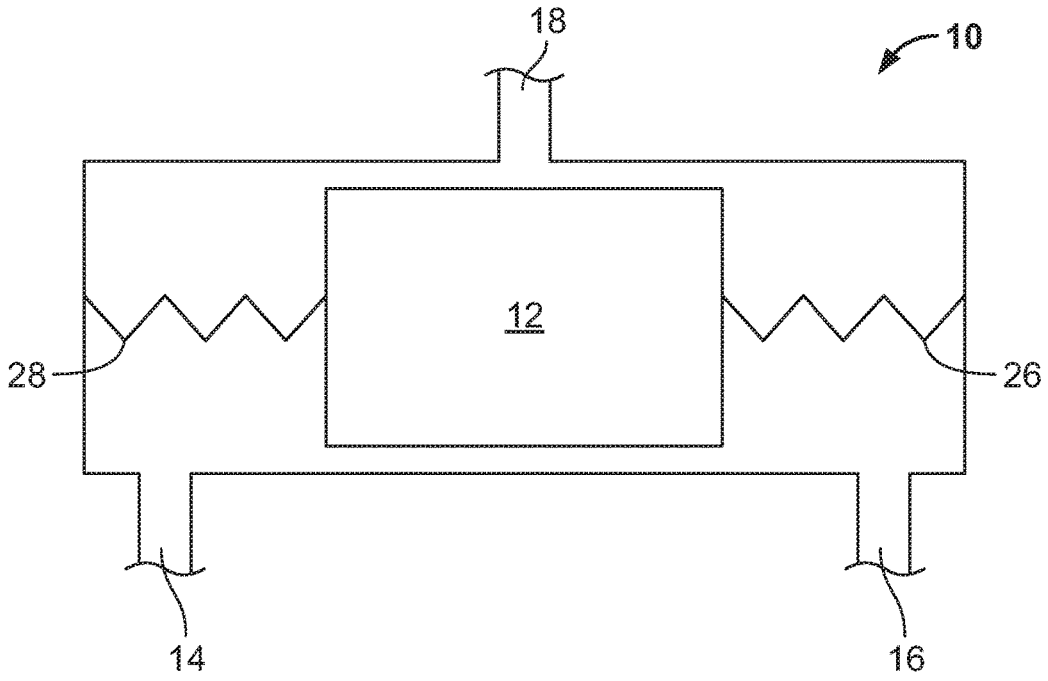
FIG. 1A depicts a simplified main hydraulic valve.

FIG. 1A depicts hydraulic valve 10 having two inputs 14, 16 for receiving hydraulic fluid pressure and one output 18 for applying hydraulic fluid pressure. Hydraulic valve 10 has a slider 12 located within valve body 20. Slider 12 is a cylindrical object sized to fit within the associated cylindrical cavity of valve body 20 as shown in FIG. 1A Hydraulic valve 10 operates as follows. Hydraulic fluid pressure applied to input 14 urges slider away from input 14 toward input 16, compressing spring 26. Hydraulic fluid pressure applied to input 16 urges slider 12 away from input 16 toward input 14, compressing spring 28. If the hydraulic fluid pressures applied to input 14 and input 16 are substantially the same, slider 12 remains stationary. If hydraulic fluid pressure applied to one input is higher than hydraulic fluid pressure applied to the other input, slider 12 will be urged to move away from the input having the higher hydraulic fluid pressure. Sufficient movement of slider 12 uncovers output 18 which allows hydraulic fluid pressure to be applied from either input 14 or input 16, depending on which input has a higher hydraulic fluid pressure applied.

Slider 12 does not move in response to increased hydraulic fluid pressure because of static friction between slider 12 and the inner surface of valve body 20. When hydraulic fluid pressure applied to input 14 is sufficiently higher to overcome static friction, slider 12 begins to move and kinetic friction, which is lower than the static friction, occurs between slider 12 and inner surface of valve body 20. The static friction can cause a delay between when actuation of hydraulic valve 10 is requested and when hydraulic valve 10 is actuated. In one embodiment, slider 12 is sized to fit within inner surface of valve body 20 to prevent the flow of hydraulic fluid between slider 12 and valve body 20. In another embodiment, O-rings are used but stiction still occurs between slider 12 and valve body 20, and in many cases the resulting stiction is higher than without O-rings.

Figure 1B:
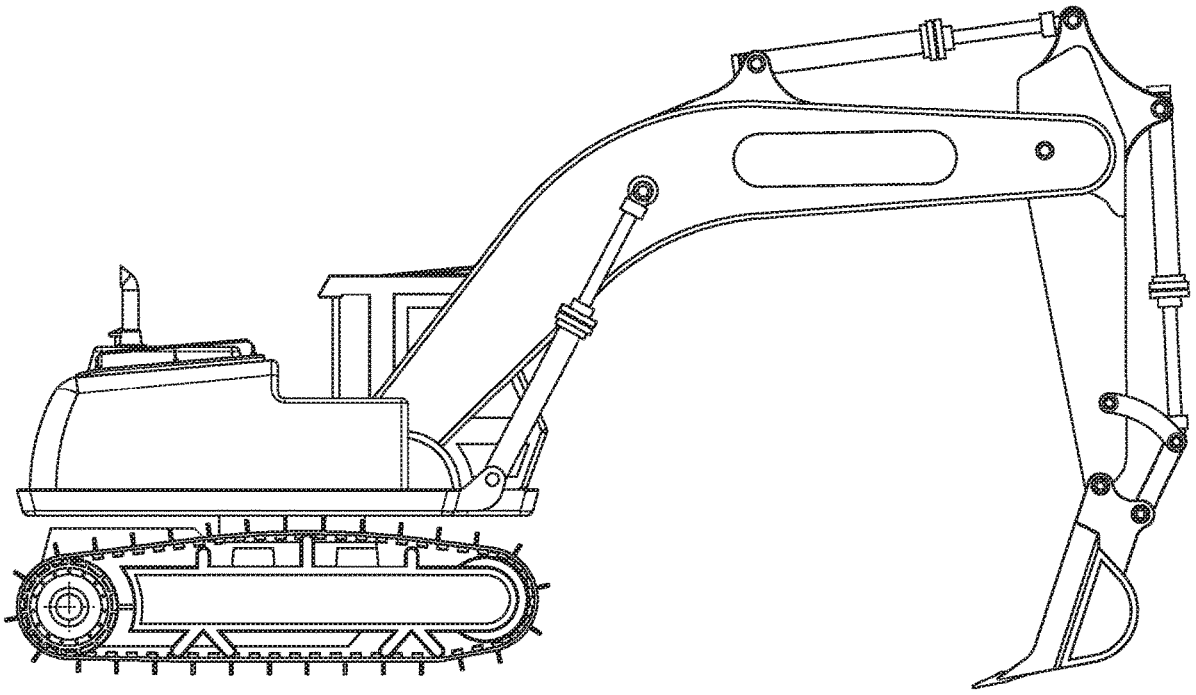
FIG. 1B depicts a construction machine, specifically an excavator, for modifying a construction site.

FIG. 1B shows a construction machine, specifically excavator 100. Excavator 100 has a boom 102, a stick 104, and a bucket 106 each of which can be controlled by a user located in cab 108 of excavator 100. Boom 102, stick, 104, and bucket 106 together are referred to as an implement (e.g., a surface modifying implement) of excavator 100. Cab 108 is part of what is referred to as the body of excavator 100 which can include treads or other means of conveyance. In one embodiment, the user actuates a control device (e.g., a joystick) located in cab 108 to move boom 102, ultimately via hydraulic fluid pressure applied to hydraulic cylinder 110. The user actuates another control device to move stick 104 via hydraulic fluid pressure applied to hydraulic cylinder 112. The user actuates an additional control device to move bucket 106 via hydraulic fluid pressure applied to hydraulic cylinder 116.

Figure 2:
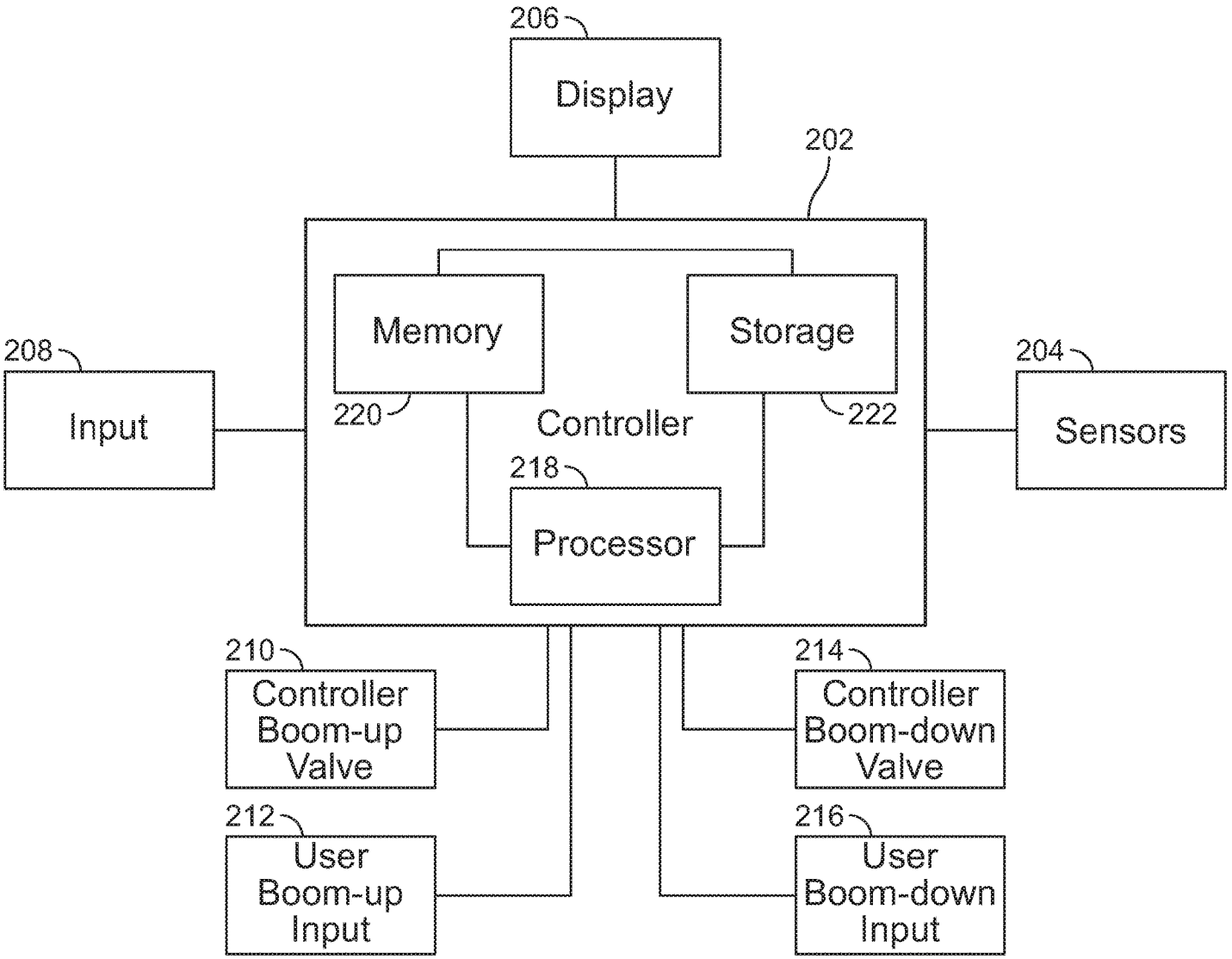
FIG. 2 depicts an electronic control system associated with the excavator.

FIG. 2 depicts a schematic of components of excavator 100 related to control of boom 102 according to an embodiment. Controller 202 can be an electric control device such as a programmable logic controller, application specific integrated circuit (ASIC), field programmable gate array (FPGA), etc. In one embodiment, controller 202 is implemented using a computer. Controller 202 contains a processor 218 which controls the overall operation of the controller 202 by executing computer program instructions which define such operation. The computer program instructions may be stored in a storage device 222, or other computer readable medium (e.g., magnetic disk, CD ROM, etc.), and loaded into memory 220 when execution of the computer program instructions is desired. Thus, the method steps of FIG. 13 (described below) can be defined by the computer program instructions stored in the memory 220 and/or storage 222 and controlled by the processor 218 executing the computer program instructions. For example, the computer program instructions can be implemented as computer executable code programmed by one skilled in the art to perform an algorithm defined by the method steps of FIG. 13. Accordingly, by executing the computer program instructions, the processor 218 executes an algorithm defined by the method steps of FIG. 13. One skilled in the art will recognize that an implementation of a controller could contain other components as well, and that controller 202 is a high level representation of some of the components of such a controller for illustrative purposes.

Sensors 204, represents one or more sensors for detecting a state of excavator 100, such as an orientation of the implement and operating parameters such as fluid pressures and temperatures. In one embodiment, the orientation of the implement is determined using linear or rotary sensors and/or inertial measurement units for determining the position boom 102, stick 104, and bucket 106 of the implement.

Inputs 208, 212 and 216 represent various input devices for operating excavator 100. In one embodiment, input 208 can include one or more control devices (e.g. joysticks) for moving boom 102, stick 104, and bucket 106. For example, a boom joystick can be actuated by the user to command boom 102 to raise or lower. Similarly, a stick joystick (i.e., a joystick for controlling movement of stick 104) can be actuated by the user to command stick 104 toward body of excavator 100 or away from body of excavator 100. A bucket joystick can be actuated by the user to command bucket 106 to move toward body of excavator 100 or away from body of excavator 100. In one embodiment, inputs associated with joysticks are signals from sensors associated with each respective joystick. Input 208 can also include inputs from a user via input devices such as touch screens, buttons, and other types of inputs.

Display 206, in one embodiment, is located in the cab of excavator 100 and displays information to a user. Display 206 can be any type of display such as a touch screen, a light emitting diode display, a liquid crystal display, etc. Display 206 presents various information to a user concerning a related machine, a current site plan, a desired site plan, etc.

Controller 202 is connected to multiple electro-mechanical control valves (e.g. 210, 214, and others not shown) each associated with movement of boom 102 of excavator 100. An electro-mechanical control valve 210 receives electric signals from controller 202 and, in response, applies hydraulic fluid pressure to its output. Controller boom-up valve 210, in one embodiment, is used to control upward movement of boom 102 of excavator 100 by directing hydraulic fluid pressure to a first input of hydraulic main valve 10 that controls cylinder 110 associated with boom 102. Controller boom-down valve 214 is an electro-mechanical control valve that is used to control downward movement of boom 102 of excavator 100 by directing hydraulic fluid pressure to a second input of hydraulic main valve 10 connected to hydraulic cylinder 110 associated with boom 102. Controller 202 would typically also be connected to electric joystick control valves, via input 208 (not shown) for controlling stick 104 and bucket 106 or other machinery associated with excavator 100. The electro-mechanical control valves for controlling stick 104 and bucket 106 operate in a manner similar to the electro-mechanical control valves for controlling boom and are therefore not shown.

In one embodiment, controller 202 receives data from input 208 and sensors 204. Controller 202 analyzes the received data and determines excavator operation information for display to a user via display 206 and determines if outputs should be sent to controller boom-up valve 210 and/or controller boom-down valve 214 to control boom 102. In one embodiment, controller 202 outputs signals to controller boom-up valve 210, and/or controller boom-down valve 214, in the absence of control inputs from a user to mitigate stiction as described below.

Figure 3:
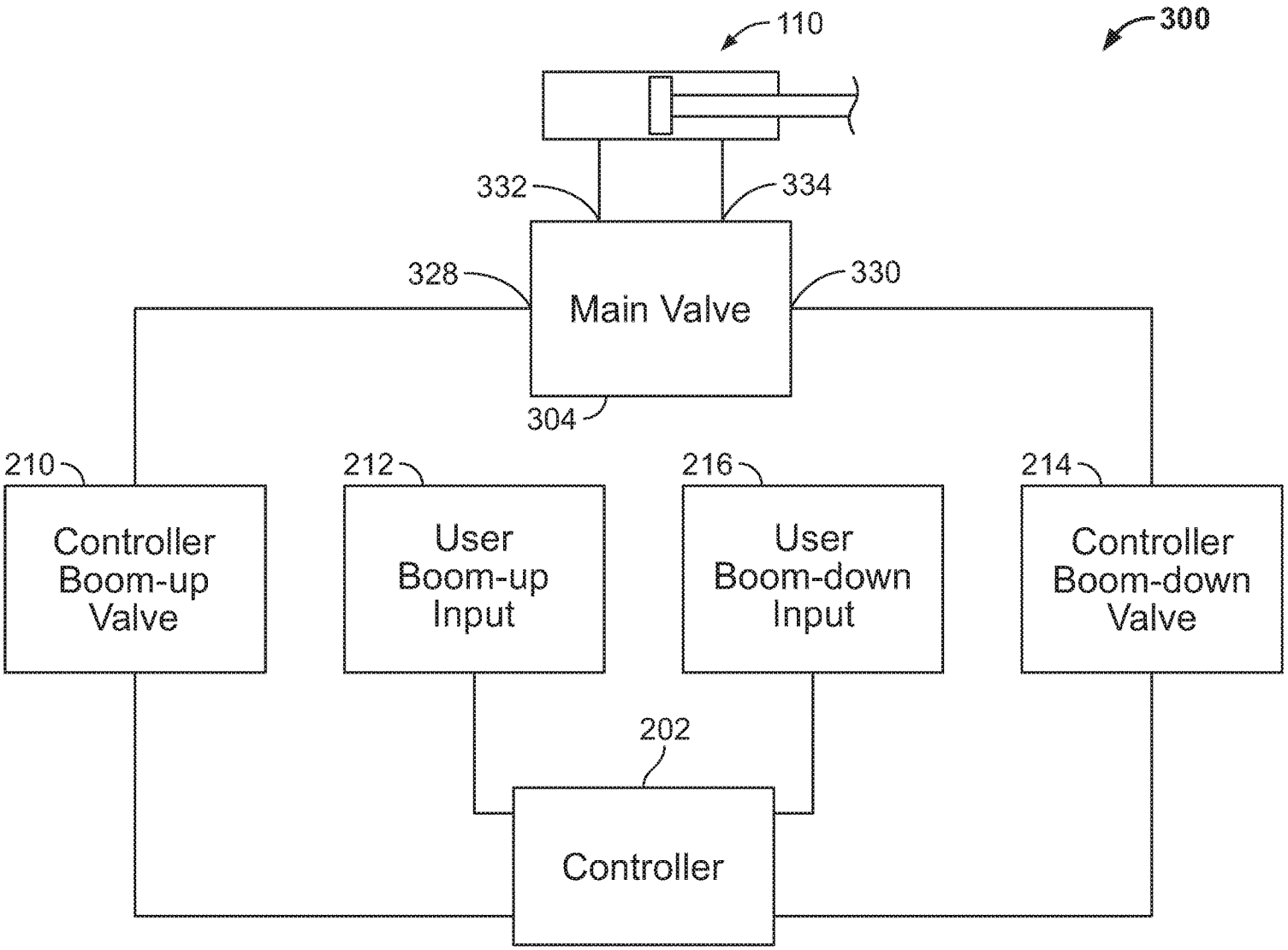
FIG. 3 depicts a schematic of a portion of a hydraulic system of the excavator.

FIG. 3 shows a schematic of a portion of a hydraulic system 300 of excavator 100 for controlling movement of boom (102 of FIG. 1). Hydraulic systems of excavator 100 for controlling movement of stick (104 of FIG. 1) and bucket (106 of FIG. 1) are similar and therefore not shown. Hydraulic cylinder 110 is connected to boom 102 which it moves in response to hydraulic fluid pressure applied from main valve 304. Main valve 304 is a hydraulic valve that applies hydraulic fluid pressure to hydraulic cylinder 110 via output 332 or output 334 in response to hydraulic fluid pressure applied to input 328 or input 330 of main valve 304. For example, when hydraulic fluid pressure is applied to input 328 and no hydraulic fluid pressure is applied to input 330, main valve 304 outputs hydraulic fluid pressure to output 332 which is applied to hydraulic cylinder 110 causing it to actuate and move boom (102 of FIG. 1B) upward. When hydraulic fluid pressure is applied to input 330 and no hydraulic fluid pressure is applied to input 328, main valve 304 outputs hydraulic fluid pressure to output 334 which is applied to hydraulic cylinder 110 causing it to actuate and move boom (102 of FIG. 1B) downward.

Input 328 receives hydraulic fluid pressure from controller boom-up valve 210 which receives signals from controller 202, in response to user boom-up input 212 or from internally generated signals.

Input 330 receives hydraulic fluid pressure from controller boom-down valve 214 which receives signals from controller 202, which receives signals from controller 202 based on user input received via user boom-down input 216, or from internally generated signals.

Main valve 304 experiences stiction which can cause a delay from the time a valve is actuated by controller 202 to the time when hydraulic cylinder 110 begins to move. In one embodiment, the stiction of main valve 304 is mitigated by dithering main valve 304 via its inputs 328 and 330.

Figure 4:
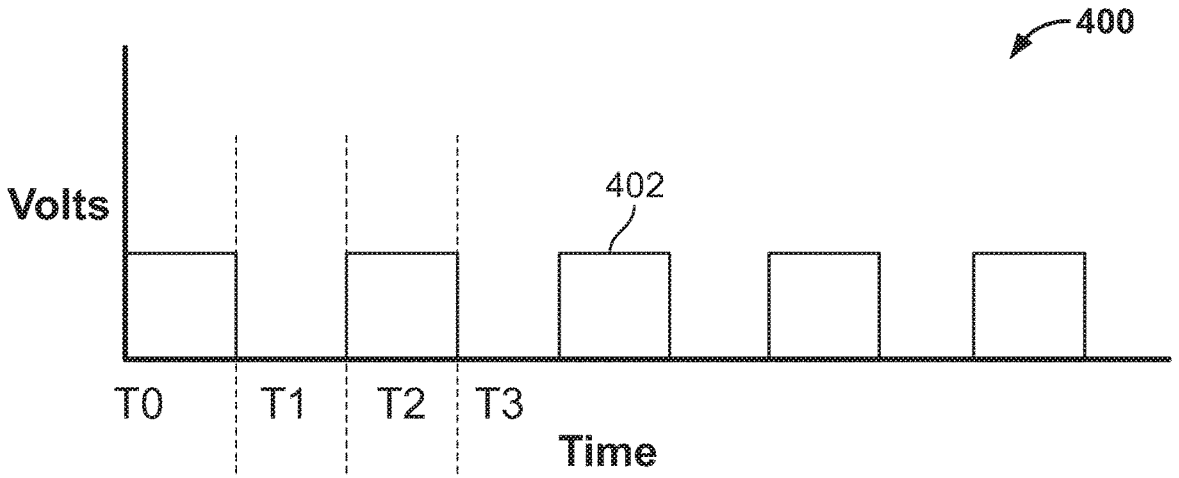
FIG. 4 depicts a graph of a signal applied to a controller boom-up valve from a controller.
Figure 5:
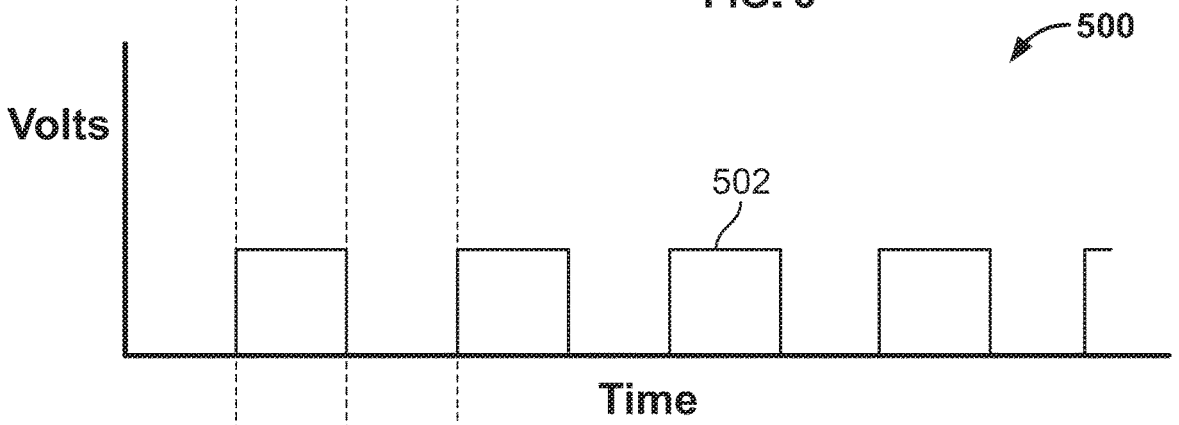
FIG. 5 depicts a graph of a signal applied to a user boom-up valve from the controller.
Figure 6:
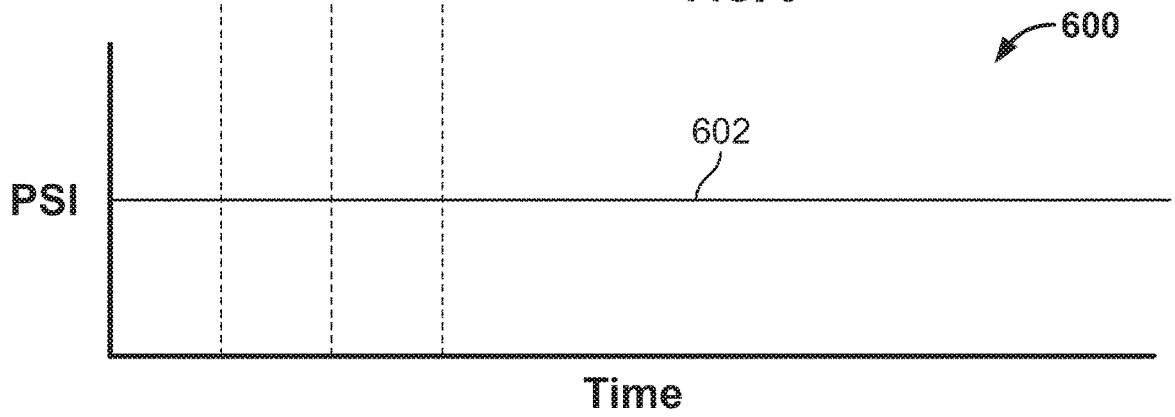
FIG. 6 depicts a graph of hydraulic fluid pressure output from a boom-up valve.
Figure 7:
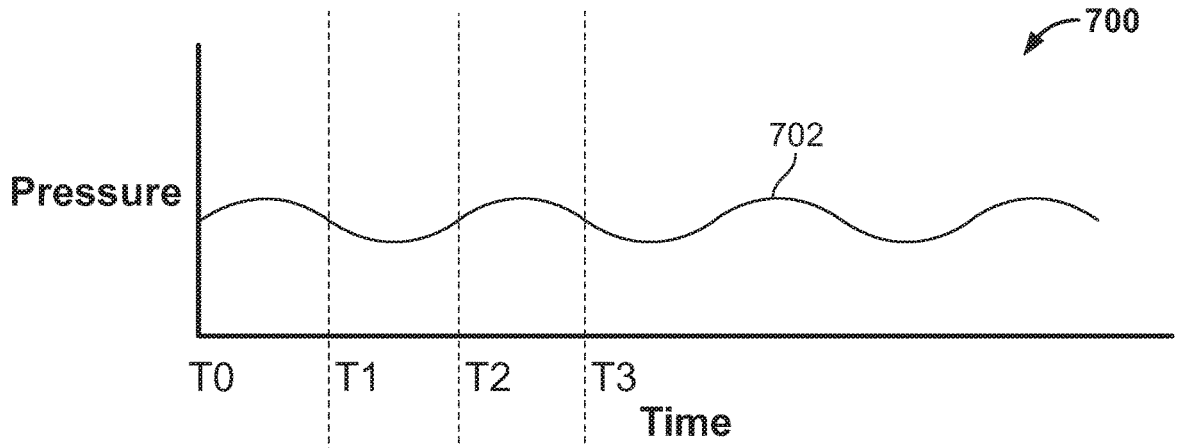
FIG. 7 depicts a graph of hydraulic fluid pressure at a first input of a main valve.
Figure 8:
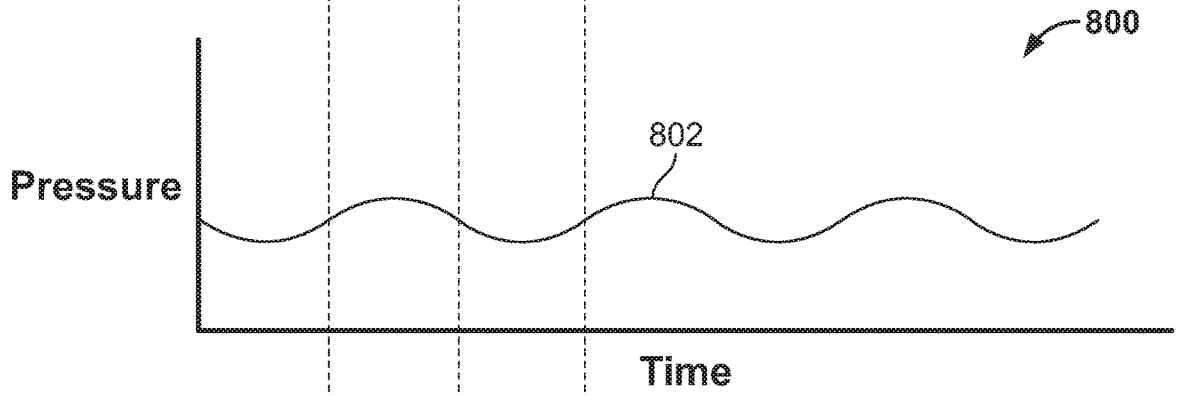
FIG. 8 depicts a graph of hydraulic fluid pressure at a second input of the main valve.
Figure 9:
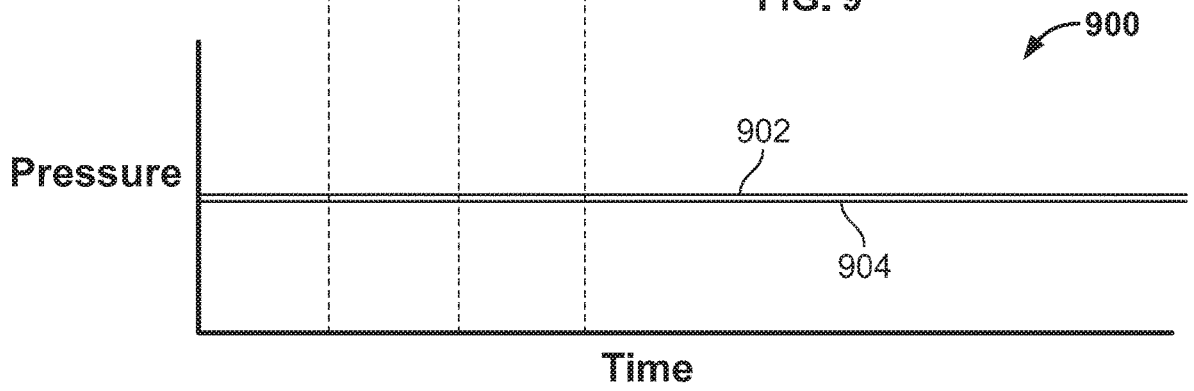
FIG. 9 depicts a graph of hydraulic fluid pressures at a first and second output of the main valve.
Figure 10:
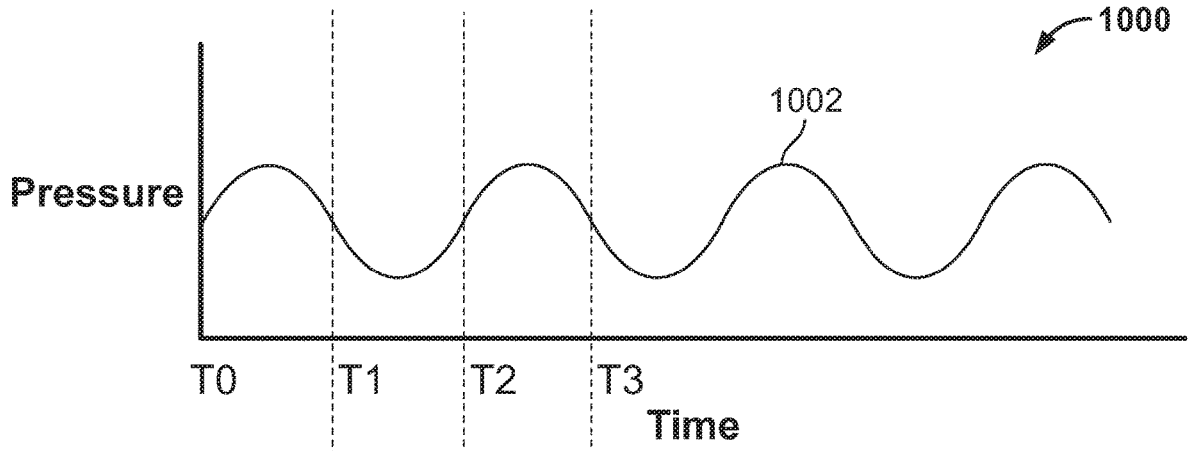
FIG. 10 depicts a graph of hydraulic fluid pressure at a first input of a main valve.
Figure 11:
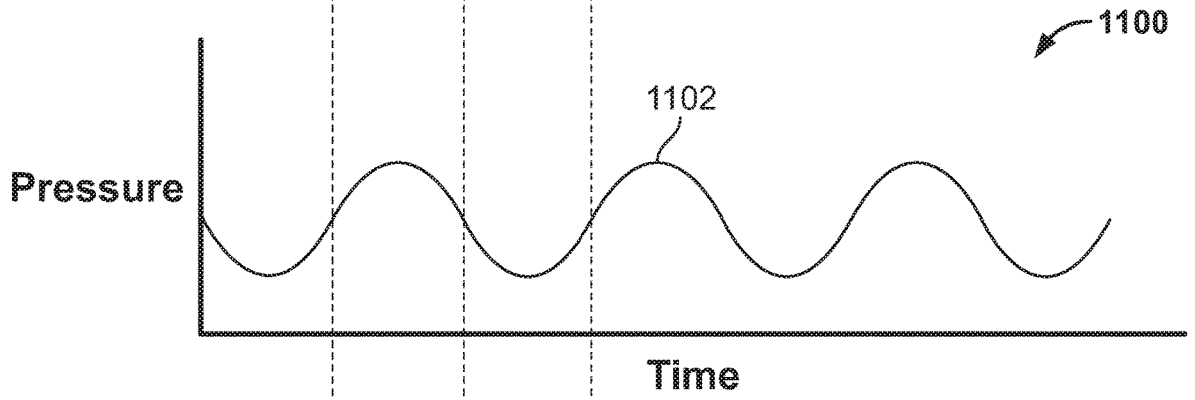
FIG. 11 depicts a graph of hydraulic fluid pressure at a second input of a main valve.
Figure 12:
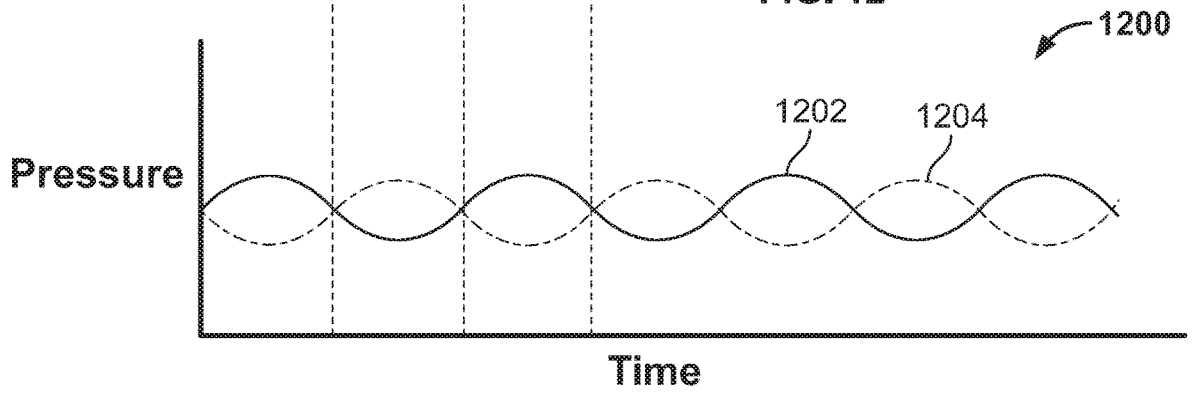
FIG. 12 depicts a graph of hydraulic fluid pressures at a first output and a second output of the main valve.

FIGS. 4-12 depict various examples of valves being dithered, with various amplitudes. FIGS. 4-6 depict graphs in which controller boom-up valve 210 and controller boom-down valve 214 are both dithered, but the dithering of those valves is insufficient to cause dithering in their outputs. FIGS. 7-9 depict graphs in which controller boom-up valve 210, and controller boom-down valve 214 are both dithered, with a signal level greater than in FIGS. 4-6, but their output pressure variations are present but insufficient to cause dithering in main valve 304. FIGS. 10-12 depict graphs in which controller boom-up valve 210 and controller boom-down valve 214 are dithered, with sufficient amplitude to produce dithered pressure control signals at main valve inputs 328 and 330.

FIGS. 4-6 depict graphs of dithering electrical signals applied to controller boom-up valve 210, controller boom-down valve 214 by controller 202 and resulting hydraulic fluid pressures 602 applied to main valve 304 via 328 and 330. The graphs shown in FIGS. 4-6 have the same time scale and signal events are shown with respect to times $T_0$, $T_1$, $T_2$, and $T_3$, etc. FIG. 6 shows that insufficient dither amplitude produces no dither in the outputs of either 210 or 214.

FIG. 4 depicts graph 400 showing voltage over time of dithering electrical signal 402. In this embodiment, dithering electrical signal 402 is a square wave that is added to controller boom-up valve 210 by controller 202. Dithering electrical signal 402 applied to controller boom-up valve 210 causes hydraulic fluid pressure to be output from controller boom-up valve 210 which is applied to main valve 304. FIG. 5 depicts graph 500 showing voltage over time of signal 502. Signal 502 is applied to controller boom-down 214 by controller 202. Signals 402 and 502 are pulse width modulated signals having duty cycles selected to modulate hydraulic fluid pressure on the outputs of 210 and 214. In one embodiment, signals 402 and 502 also have an additional signal that is changed depending on a desired hydraulic fluid pressure to be output from valves 210 and 214.

As shown in FIGS. 4 and 5, dithering electrical signals 402 and 502 are 180 degrees out of phase. As shown in FIGS. 4 and 5, at time $T_0$, signal 402 is high and signal 502 is low. At time $T_1$, signal 402 is low and signal 502 is high. The combination of the amplitude of signals 402 and 502 and being out of phase causes periodically varying hydraulic fluid pressure to be applied to inputs 328 and 330 of boom main valve 304. Since signals 402 and 502 are out of phase, the hydraulic fluid pressures applied to inputs 328 and 330 will also be out of phase. Main valve 304 applies hydraulic fluid pressure to hydraulic cylinder 110 in response to hydraulic fluid pressure at input 328 of main valve 304 from boom-up valve 210.

FIG. 6 depicts graph 600 of hydraulic fluid pressure over time at input 328 of main valve 304. Output pressure 602 is shown in FIG. 6 having a constant value that, in one embodiment, can range from zero up to a value prior to hydraulic fluid pressure that will cause main valve 304 to actuate. The operation of controller boom-up valve 210 as shown in FIG. 4, with minimal variation of hydraulic fluid pressure applied to input 328 of main valve 304 as shown by output pressure 602 in FIG. 6, results in no movement in main valve 304 and no reduction in its stiction.

Boom-down valve 214 can be operated in a manner similar to the operation of boom-up valve 210 as described above.

FIGS. 7 and 8 depict graphs of hydraulic fluid pressures applied to inputs 328 and 330 of main valve 304 when boom-up valve 210 and boom-down valve 214 are dithered as shown, for example, in FIGS. 4 and 5 and no user inputs are being received. The graphs shown in FIGS. 7-9 have the same time scale and events are shown with respect to times $T_0$, $T_1$, $T_2$, and $T_3$, etc.

FIG. 7 depicts graph 700 showing hydraulic fluid pressure values at input 328 of main valve 304 over time. Hydraulic fluid pressure 702 is shown having values over time forming a sinusoidal shape that is the response of the valve to the dithering signal.

FIG. 8 depicts graph 800 showing hydraulic fluid pressure values at input 330 of main valve 304 over time. Hydraulic fluid pressure 802 is shown having values over time forming a sinusoidal shape that is in response to dithering boom-down valve 320.

FIGS. 7 and 8 show that sinusoidal waveforms 702 and 802 are out of phase by 180 degrees. As shown in FIGS. 7 and 8, at time $T_0$ hydraulic fluid pressure shown by waveform 702 is climbing higher while hydraulic fluid pressure shown by waveform 802 is descending lower. At time $T_1$, waveform 702 is shown descending lower while waveform 802 is climbing higher. In one embodiment, this alternating high and low of waveforms 702 and 802 continues as long as user input commanding boom 102 to move is not received. The amplitudes of waveforms 702 and 802 shown in FIGS. 7 and 8 are insufficient to cause main valve 304 to dither.

FIG. 9 depicts graph 900 of hydraulic fluid pressure over time at output 332 and output 334 of main valve 304 in response to hydraulic fluid pressures applied to inputs 328 and 330 of main valve 304 as depicted in FIGS. 7 and 8, respectively. Hydraulic fluid pressure 902 at output 332 is shown in FIG. 9 having a constant value that, in one embodiment, can range from zero up to a value prior to hydraulic fluid pressure that would cause hydraulic cylinder 110 to move. Hydraulic fluid pressure 904 at output 334 is shown in FIG. 9 having a constant value that, in one embodiment, can range from zero up to a value prior to hydraulic fluid pressure that would cause hydraulic cylinder 110 to move.

FIGS. 10 and 11 depict graphs of hydraulic fluid pressures applied to inputs 328 and 330 of main valve 304 when no user inputs are being received. The graphs show increased dither amplitude, and also show that sinusoidal waveforms 1002 and 1102 are still out of phase by 180 degrees The graphs shown in FIGS. 10-12 have the same time scale and events are shown with respect to times $T_0$, $T_1$, $T_2$, and $T_3$, etc.

FIG. 10 depicts graph 1000 showing hydraulic fluid pressure values at input 328 of main valve 304 over time. Hydraulic fluid pressure 1002 is shown having values over time forming a sinusoidal shape that is in response to dithering of boom-up valve 210.

FIG. 11 depicts graph 1100 showing hydraulic fluid pressure values at input 330 of main valve 304 over time. Hydraulic fluid pressure 1102 is shown having values over time forming a sinusoidal shape that is in response to dithering boom-down valve 214.

It should be noted that waveforms 1002 and 1102 are similar to waveforms 700 and 800. Each of waveforms 702, 802, 1002, and 1102 depicts periodically varying hydraulic fluid pressure at a particular point. The amplitudes of waveforms 1002 and 1102 are higher than the amplitudes of waveforms 702 and 802. The higher amplitudes of waveforms 1002 and 1102 cause main valve 304 to dither which mitigates stiction of main valve 304.

FIG. 12 depicts graph 1200 showing hydraulic fluid pressure applied to input 328 and hydraulic fluid pressure applied to input 330 over time. As shown in FIG. 12, waveform 1202 is out of phase with waveform 1204 by 180 degrees. The alternating pressures applied via inputs 328 and 330 are in response to dithering valve 210 and 214 with an amount of dither that exceeds the amount necessary just to reduce their stiction. It should be noted that the dithering of main valve 304 overcomes the stiction of main valve 304. However, the hydraulic fluid pressure applied to inputs 328 and 330 do not contain enough sinusoidal variations cause variations in the outputs 332 and 334, and therefore hydraulic cylinder 110 does not move in response to the dither. Thus, the stiction of main valve 304 is mitigated without causing movement of hydraulic cylinder 110.

The graph of signal 1002 in FIG. 10 can be modified with the addition of a control signal, such that the shape remains the same but the average pressure level is higher, causing main valve 304 to shift and create pressure at 332, extending cylinder 110 and raising boom 102.

The graph of signal 1102 in FIG. 11 can be modified with the addition of a control signal, such that the shape remains the same but the average pressure level is higher, causing main valve 304 to shift and create pressure at 334, retracting cylinder 110 and lowering boom 102.

The net amount of dither to main valve 304 can be adjusted by varying the amplitudes dither signals 402 and 502. This net amount can also vary based on the value of the control signal added in graph 1000 or 1100, such that the net difference to main value 304 remains the same but the inactive opposite side reaches zero and it corresponding dither disappears, replaced by dither only on the active side. This remaining active dither+control signal would be equal to the amount needed to both control output 332 or 334, and reduce stiction in main valve and the corresponding active controller valve.

Figure 13:
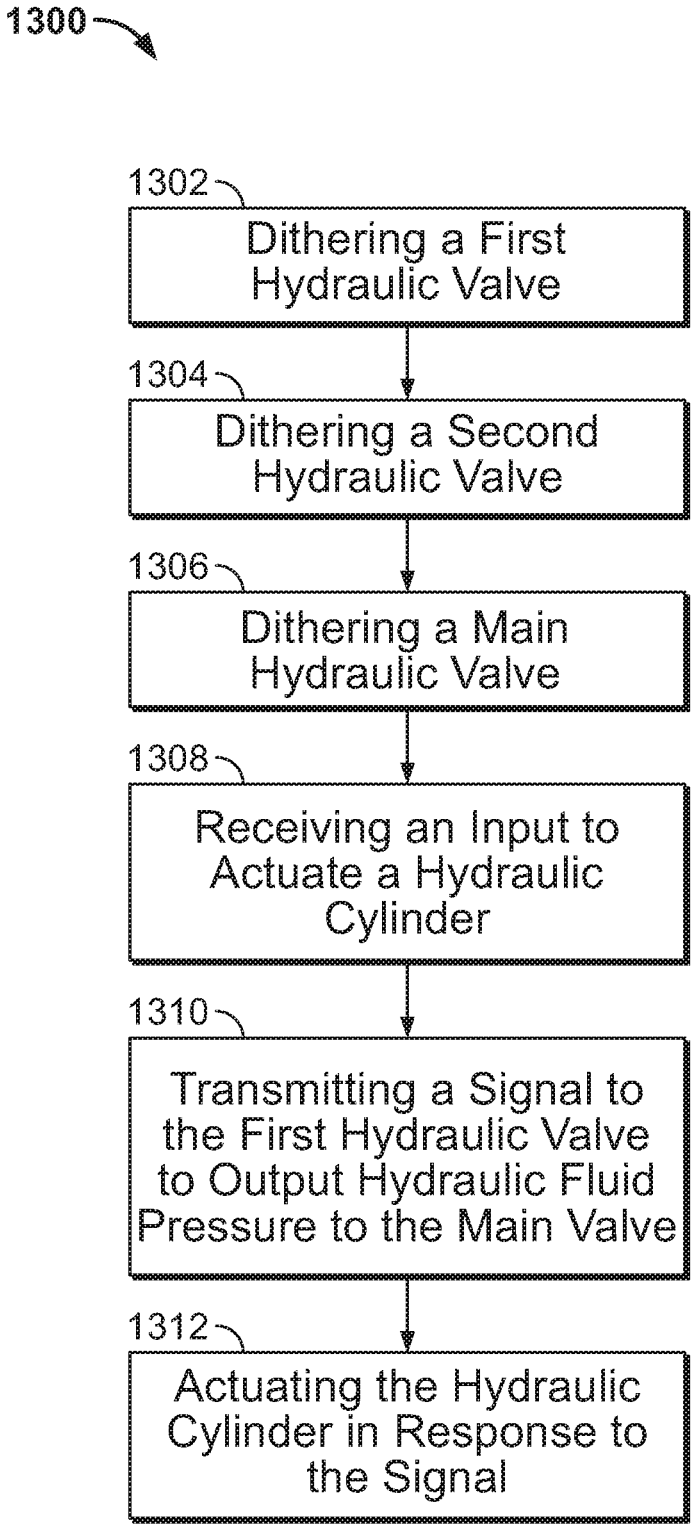
FIG. 13 depicts a flowchart of a method according to an embodiment of the invention.

FIG. 13 depicts a flowchart of a method 1300 for mitigating stiction of valves (i.e., two pilot control valves and a main valve) of a hydraulic system according to an embodiment. At step 1302, a first hydraulic valve is dithered, with a signal beyond what is needed to remove its inherent dither. In one embodiment, boom-up control valve 210 shown in FIG. 3 is dithered. At step 1304, a second hydraulic valve 214 is dithered, also with a signal beyond what is needed to remove its inherent dither. The dithering of boom-up valve 210 and boom-down valve 214 causes hydraulic fluid pressure to be applied to inputs 328 and 330 of main valve 304 as shown in FIGS. 10 and 11. At step 1306, main valve 304 is dithered by the hydraulic fluid pressure applied to inputs 328 and 330. Dithering of main valve 304 reduces or eliminates stiction in spool 12 of the main valve 304. In one embodiment, the variations in pressures at 328 and 330 are sufficient to mitigate stiction of spool 12 in main valve 304, but are insufficient to cause hydraulic fluid pressure variations in outputs 332 and 334 and to cause hydraulic cylinder 110 to move in response.

At step 1308, an input to actuate hydraulic cylinder 110 is received by controller 202 shown in FIG. 2. In one embodiment, input is received from a joystick of input 208 shown in FIG. 2. At step 1310, controller 202 outputs a signal to one of controller boom-up 210 or controller boom-down 214 shown in FIG. 3 in response to the joystick input. The signal causes hydraulic fluid pressure to be added to the dither signal and applied by valve 210 to input 328 or valve 214 to input 330 of main valve 304. Valve 304 responds to the net difference in pressure at inputs 328 and 330, and, at step 1312, the hydraulic cylinder 110 is actuated by the hydraulic fluid pressure applied via outputs 332 or 334 of main valve 304.

It should be noted that stiction of other types of hydraulic valves for various applications can be dithered in a similar manner to mitigate stiction. Accordingly, the stiction associated with hydraulic valves for moving stick 104 and bucket 106 of excavator 100 can be mitigated using methods similar to those described above in connection with boom 102.

The foregoing Detailed Description is to be understood as being in every respect illustrative and exemplary, but not restrictive, and the scope of the inventive concept disclosed herein is not to be determined from the Detailed Description, but rather from the claims as interpreted according to the full breadth permitted by the patent laws. It is to be understood that the embodiments shown and described herein are only illustrative of the principles of the inventive concept and that various modifications may be implemented by those skilled in the art without departing from the scope and spirit of the inventive concept. Those skilled in the art could implement various other feature combinations without departing from the scope and spirit of the inventive concept.

The invention claimed is:

1. A method comprising:

dithering a first hydraulic valve to produce a first periodically varying hydraulic fluid pressure applied to a first input of a second hydraulic valve; and dithering a third hydraulic valve to produce a second periodically varying hydraulic fluid pressure 180 degrees out of phase with the first periodically varying hydraulic fluid pressure and applied to a second input of the second hydraulic valve, wherein the first periodically varying hydraulic fluid pressure and the second periodically varying fluid pressure applied to the first input and the second input of the second hydraulic valve cause the second hydraulic valve to dither, and the dithering of the second hydraulic valve causes hydraulic fluid pressure to be applied to a first input of a hydraulic cylinder and a second input of the hydraulic cylinder, wherein the hydraulic fluid pressure applied is a value lower than a value required to actuate the hydraulic cylinder.

2. The method of claim 1, wherein the dithering of the first hydraulic valve is in response to a periodically varying hydraulic fluid pressure applied to a first input of the first hydraulic valve and a periodically varying hydraulic fluid pressure applied to a second input of the first hydraulic valve.

3. The method of claim 2, wherein the dithering of the third hydraulic valve is in response to a periodically varying hydraulic fluid pressure applied to a first input of the third hydraulic valve and a periodically varying hydraulic fluid pressure applied to a second input of the third hydraulic valve.

4. The method of claim 2, wherein the dithering of the first hydraulic valve and the dithering of the third hydraulic valve mitigate stiction of the first hydraulic valve and the third hydraulic valve.

5. The method of claim 4, wherein the amplitude of the periodically varying hydraulic fluid pressure applied to the first input and the second input of the second hydraulic valve does not cause movement of a hydraulic cylinder associated with the second hydraulic valve.

6. The method of claim 1, wherein an amplitude of the periodically varying hydraulic fluid pressure applied to the first input and the second input of the second hydraulic valve is in response to the dithering of the first hydraulic valve and the dithering of the third hydraulic valve.

7. An apparatus comprising:

a first hydraulic valve having a first output;

a second hydraulic valve having a second output;

a third hydraulic valve having a first input connected to the first output and a second input connected to the second output; and a controller in communication with the first hydraulic valve and the second hydraulic valve, the controller configured to perform operations comprising:

dithering the first hydraulic valve to produce a first periodically varying hydraulic fluid pressure applied to the first input of the third hydraulic valve; and dithering the second hydraulic valve to produce a second periodically varying hydraulic fluid pressure applied to the second input of the third hydraulic valve, wherein the first periodically varying hydraulic fluid pressure and the second periodically varying fluid pressure applied to the first input and the second input of the third hydraulic valve are 180 degrees out of phase and cause the third hydraulic valve to dither, and the dithering of the second hydraulic valve causes hydraulic fluid pressure to be applied to a first input of a hydraulic cylinder and a second input of the hydraulic cylinder, wherein the hydraulic fluid pressure applied is a value lower than a value required to actuate the hydraulic cylinder.

8. The apparatus of claim 7, wherein the dithering of the first hydraulic valve is in response to a periodically varying hydraulic fluid pressure applied to a first input of the first hydraulic valve and a periodically varying hydraulic fluid pressure applied to a second input of the first hydraulic valve.

9. The apparatus of claim 8, wherein the dithering of the second hydraulic valve is in response to a periodically varying hydraulic fluid pressure applied to a first input of the second hydraulic valve and a periodically varying hydraulic fluid pressure applied to a second input of the second hydraulic valve.

10. The apparatus of claim 8, wherein the dithering of the first hydraulic valve and the dithering of the second hydraulic valve mitigate stiction of the first hydraulic valve and the second hydraulic valve.

11. The apparatus of claim 10, wherein an amplitude of the periodically varying hydraulic fluid pressure applied to the first input and the second input of the third hydraulic valve does not cause movement of a hydraulic cylinder associated with the third hydraulic valve.

12. The apparatus of claim 7, wherein an amplitude of the periodically varying hydraulic fluid pressure applied to the first input and the second input of the third hydraulic valve is in response to the dithering of the first hydraulic valve and the dithering of the second hydraulic valve.

13. An excavator comprising:

a hydraulic cylinder associated with an implement member of the excavator;

a first hydraulic valve having a first output;

a second hydraulic valve having a second output;

a third hydraulic valve having a first input connected to the first output, a second input connected to the second output, a third output connected to a first side of the hydraulic cylinder and a fourth output connected to a second side of the hydraulic cylinder; and a controller in communication with the first hydraulic valve and the second hydraulic valve, the controller configured to perform operations comprising:

dithering the first hydraulic valve to produce a first periodically varying hydraulic fluid pressure applied to the first input of the third hydraulic valve; and dithering the second hydraulic valve to produce a second periodically varying hydraulic fluid pressure applied to the second input of the third hydraulic valve, wherein the first periodically varying hydraulic fluid pressure and the second periodically varying fluid pressure applied to the first input and the second input of the third hydraulic valve are 180 degrees out of phase and cause the third hydraulic valve to dither.

14. The excavator of claim 13, wherein the implement member is a boom of the excavator.

15. The excavator of claim 13, wherein the implement member is a stick of the excavator.

16. The excavator of claim 13, wherein the implement member is a bucket of the excavator.

17. The excavator of claim 13, wherein the dithering of the third hydraulic valve causes hydraulic fluid pressure to be applied to a first input of a hydraulic cylinder and a second input of a hydraulic cylinder, wherein the hydraulic fluid pressure applied is a value lower than a value required to actuate the hydraulic cylinder.

18. The excavator of claim 13, wherein the dithering of the first hydraulic valve is in response to a periodically varying hydraulic fluid pressure applied to a first input of the first hydraulic valve and a periodically varying hydraulic fluid pressure applied to a second input of the first hydraulic valve and the dithering of the second hydraulic valve is in response to a periodically varying hydraulic fluid pressure applied to a first input of the second hydraulic valve and a periodically varying hydraulic fluid pressure applied to a second input of the second hydraulic valve.

* * * * *